US005591271A

United States Patent [19]

Baeck et al.

[11] Patent Number: 5,591,271

[45] Date of Patent: Jan. 7, 1997

[54] PROCESS FOR CLEANING INDUCTOR CHANNELS OF FURNACES MELTING NON-FERROUS METAL ALLOYS

[75] Inventors: Ivo Baeck, Florencio Varela; Horacio H. Fernandez, Lomas de Zamora; Horacio Llano, Capital Federal; Ricardo M. Ali, Monte Grande, all of Argentina

[73] Assignee: Comesi S.A.I.C., Buenos Aires, Argentina

[21] Appl. No.: 413,241

[22] Filed: Mar. 30, 1995

[30] Foreign Application Priority Data

Aug. 26, 1994 [AR] Argentina ..... 329233

[51] Int. Cl.[6] ..... B08B 5/02; B08B 9/00; B08B 9/04

[52] U.S. Cl. ..... 134/8; 134/21; 134/22.1

[58] Field of Search ..... 134/8, 22.1, 21

[56] References Cited

U.S. PATENT DOCUMENTS

| | | | |
|---|---|---|---|
| 3,618,917 | 11/1971 | Fredrikson et al. | 266/34 A |
| 4,123,043 | 10/1978 | Nomine et al. | 266/158 |
| 4,251,271 | 2/1981 | Floyd | 75/73 |
| 4,724,007 | 2/1988 | Barry et al. | 134/1 |
| 5,435,948 | 7/1995 | Staffolani et al. | 264/30 |

*Primary Examiner*—Zeinab El-Arini
*Attorney, Agent, or Firm*—Kuhn and Muller

[57] ABSTRACT

A process cleans inductor channels of furnaces melting non-ferrous metal alloys wherein the coating alloy has a minimum of zinc content of 50% by weight which is subject to softening, dilution and floating of DROSS heavy slag which obstructs the inductor channels. The slag is removed by mechanical action of hammer-shock powered lances with slicing fins presented at a contact end of the lances. Cleaning of the slag is aided by a nitrogen gas stream acting within inductor channels.

4 Claims, 2 Drawing Sheets

FIG. 1
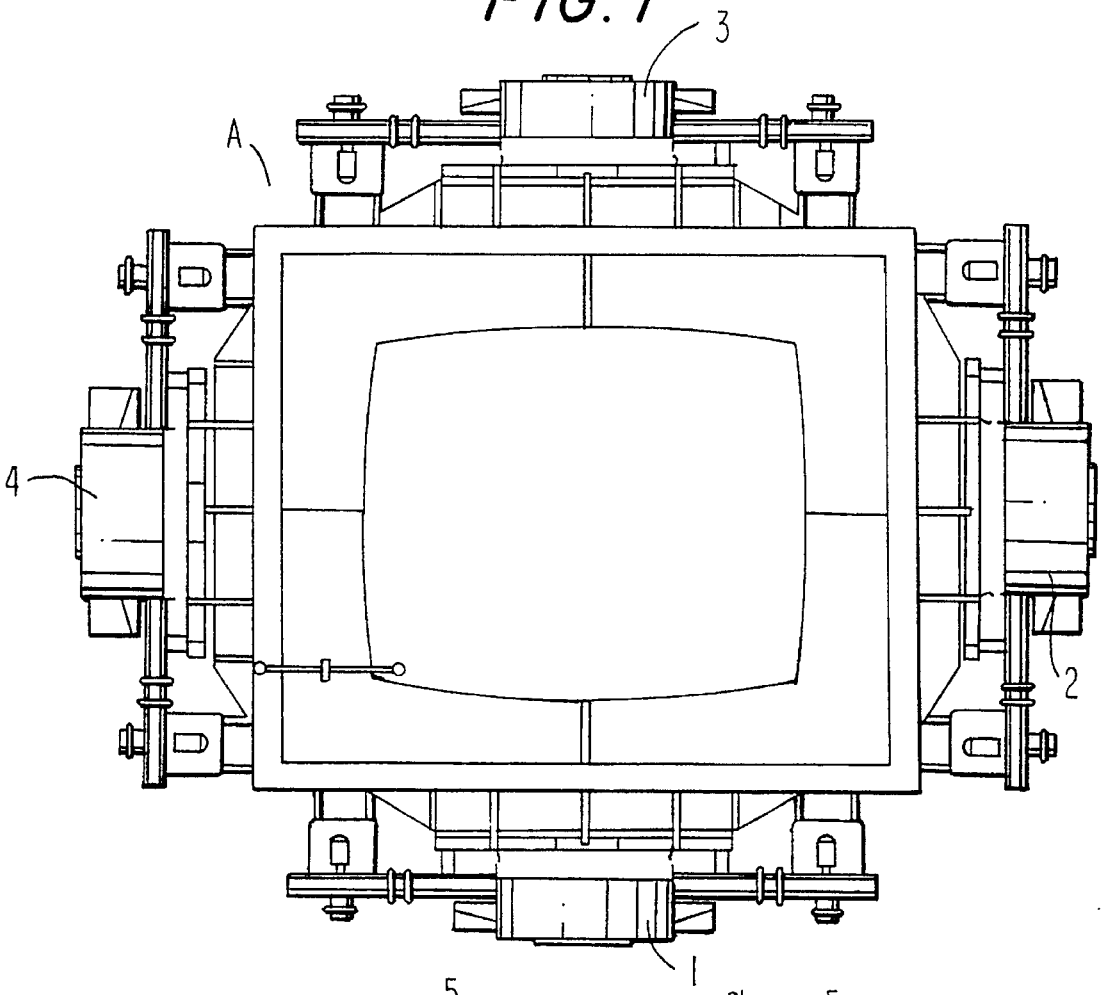
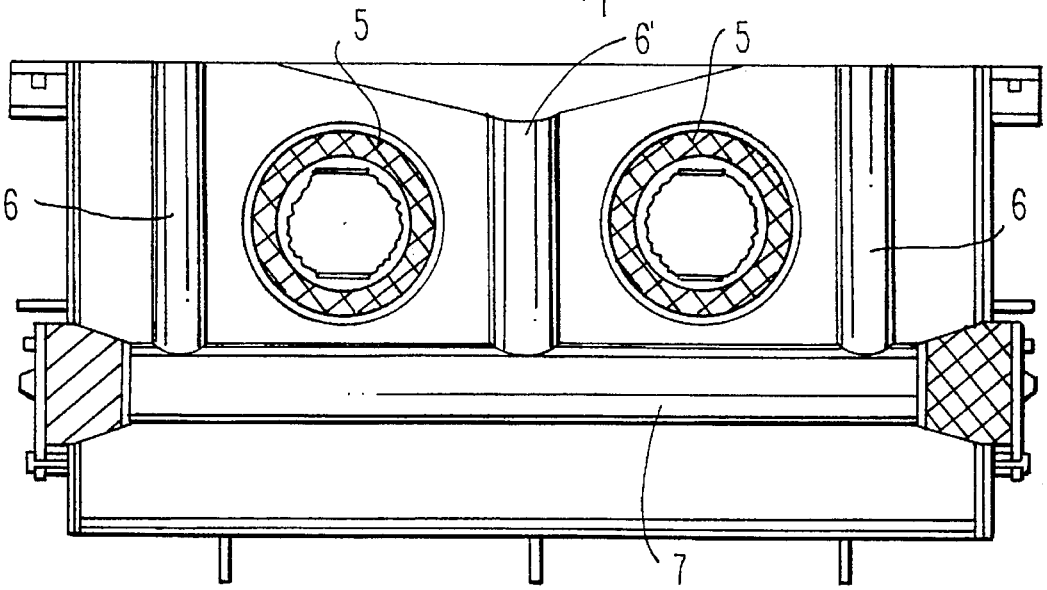
FIG. 2

PROCESS FOR CLEANING INDUCTOR CHANNELS OF FURNACES MELTING NON-FERROUS METAL ALLOYS

FIELD OF THE INVENTION

The present invention relates to a cleaning process for inductor channels of furnaces melting non-ferrous metal alloys.

BACKGROUND OF THE INVENTION—PRIOR ART

Channel blockage created upon induction heating of non-ferrous metals using channel type inductors, employed in furnaces such as that shown in FIG. 1 is known. In such furnaces the alloy flows inside refractory material channels located within the variable magnetic field induced by coils supplied by low frequency alternate current placed such as to direct the magnetic field towards the referred channels.

BRIEF DESCRIPTION OF THE DRAWING

FIG. 1 is a top plan view of the induction furnace of the present invention.

FIG. 2 is a side sectional view of a channel type inductor associated therewith.

DETAILED DESCRIPTION OF THE INVENTION

Figure 3:
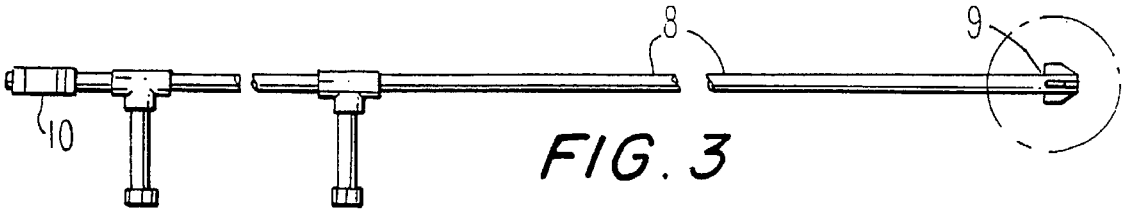
FIG. 3 shows a lance with its scraper end and a Montefiore quick coupling, respectively thereof.
Figure 4:
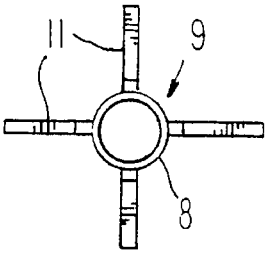
FIG. 4 is a vertical section of the end of a lance and the first driving fins thereof.
Figure 5:
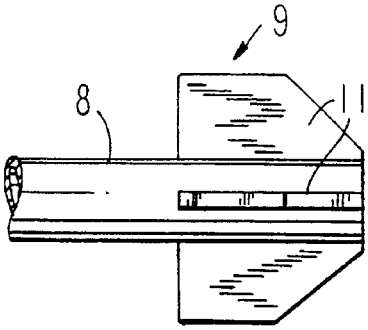
FIG. 5 is a side elevational view of the end of lance therof.
Figure 8:
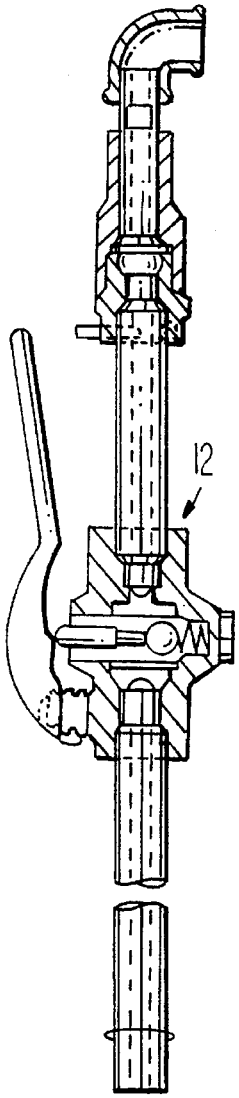
FIG. 8 is a side elevational view of the ramming hammer thereof.

As shown in FIGS. 1 and 2 an induction furnace A is provided with channel type inductors 1, 2, 3, 4. Each channel type inductor 1, 2, 3 or 4 has induction coils 5, control channel 6, side channels 6' and bottom channel 7. Lance 8, shown in FIG. 3, is used to clean the channels. Lance 8 has scraper end 9 at one end and a coupling end such as Montefoire quick coupling 10, at an opposite end. As shown in FIGS. 4 and 5, lance 8 has first driving radial fins 11 of a predetermined shape at end 9 and may also has second driving radial fins 11' of a predetermined shape with a larger diameter. FIG. 8 shows a ramming hammer 12.

Within the "W" shaped channels, alloys are heated by the induced electrical currents due to the induced magnetic field effect and, in turn, due to the same currents, the alloy flows through side channels of the "W" towards the furnace hearth and through the central channel from the furnace hearth towards the inductor.

FIG. 2 shows the general arrangement of coils and channels in a channel type inductor as that disclosed.

Within the furnace hearth the molten alloy mass may be used for different purposes, among them the hot dip coating of steel sheets. Hot dip coating implies an undesirable attack of the steel by non-ferrous metals alloys, which creates alloying of molten metals with the steel iron, thus generating insoluble inter-metallic alloys in the alloy mass. These inter-metallic alloys, generally known as DROSS, in heavy slag, due to being insoluble, tend to precipitate on the bottom of the furnace hearth and to be entrained in alloy currents towards inductor channels, wherein they also tend to precipitate, thus blocking the channels. This tendency increases with time and if heavy slag DROSS is not removed from inside the channels, these channels are completely blocked, thus resulting in the inductor failure and in the need of a furnace shutdown for replacing the defective inductors.

For overcoming channel blockage, the present invention provides a process for dragging the heavy slag, DROSS, by bubbling with inert gas of channels 6, 6' and 7, combined with the accessory mechanical action of scraper fins attached to the end 9 of lance 8 used for introducing inert gas and by hammering on the other end 10 of lance 8 with a ramming hammer 12.

Lance 8 should be made from AISI 316-L stainless steel to minimize erosion thereof by molten alloys, and such lance 8 should have at its end a plurality of radial fins 11 and 11' welded thereto, for breaking the heavy slag layer formed on the channel walls, so that DROSS heavy slag particles may be then entrained in the inert gas stream injected through lance 8.

To facilitate and strengthen the scraping mechanical action of fins 11 and 11', the free end 10 of lance 8 is hammered or shocked to aid in penetration of fins 11 and 11' into the DROSS heavy slag layer. These shocks should have a regular sequence, therefore multiple shock ramming hammers 12 are used, wherein the compressed air flow should be regulated in order to obtain a regular number of shocks per time unit.

In order to facilitate the gas scanning, the mechanical work of fins 11 and 11' and the application of shocks, it has been found that, in the case of zinc-aluminum-silicon alloys, the heavy slag softens considerably and tends to float over the bath surface upon increasing the zinc contents in the alloy. Therefore it is important that the zinc contents before starting the scraping-bubbling process be adjusted to a minimum of 50% zinc in order to attain softening of the heavy slag, which is insoluble, and allow gas scraping-bubbling of channels 6, 6' and 7.

OPERATION

1. Adjustment of the Molten Alloy Bath Composition

The furnace hearth contents is casted into ingots or any other proper means, the hearth being equipped with inductors 1, 2, 3 and 4 in which channels 6, 6' and 7 are to be cleaned, with the addition of zinc, in order to increase the alloy zinc contents up to minimum of 50% by weight.

2. Removal of Heavy Slag from the Hearth Bottom and from the Molten Bath

Heavy slag or DROSS built up at the bottom of the hearth is to be removed using proper blades or skimmers. Then, by means of inert gas bubbling at the bottom of the hearth, flotation over the hearth surface of the DROSS remaining in the bath is caused, and heavy slag is removed from the surface by means of buckets or the like.

3. Channel Bubbling

Figure 6:
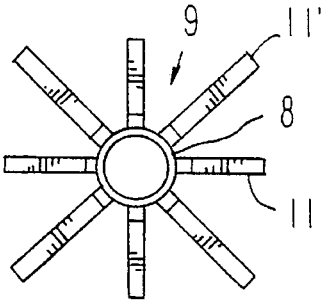
FIG. 6 is a vertical sectional view of the end of the lance with second driving fins of higher diameter than the first fins thereof.
Figure 7:
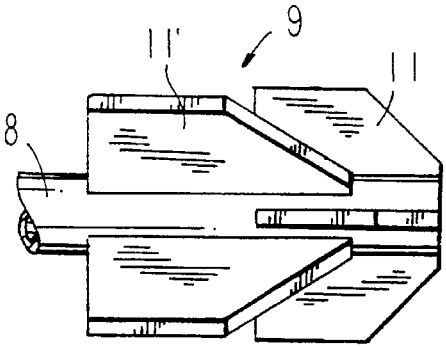
FIG. 7 is another side elevational view of the lance end with first and second driving fins and having different diameters thereof.

Once slag is removed from the molten alloy bath, bubbling and scraping of channels 6, 6' and 7 of inductors 1, 2, 3 and 4 is effected. To this end, lance 8 such as shown in FIGS. 3 and 4 is used, to which fins 11 are added, welded to the working end 9 thereof. Such fins 11 may have different configurations, some of which are shown in FIGS. 3 and 4. Fins 11 should have increasing diameters such that the scrapping diameter may be increased in several steps, thus increasing the channel gage progressively up to its normal diameter; otherwise, additional fins 11' should be provided with increasing height, in order to obtain a progressive mechanical scraping of the channels, 6, 6' or 7 with a single pass of the lance 8 and a ramming hammer 12 (as shown in FIGS. 6–8) at the other end 10. Power to the inductor to be cleaned is shut off and a lance 8 is introduced into each side channel 6. Frequency of hammer shocks by hammer 12 is increased to a proper value of at least 5 shocks per minute and inert gas, such as nitrogen, is admitted at a pressure of at least 0.1 kg/cm$^2$, and lance 8 is left until its penetration to the bottom of each channel 6. Once the bottom of side channels 6 is reached, the inductors 1, 2, 3, 4 are energized in order to recover the normal working temperature and, once attained, the operation is repeated for the central channel 6' of the inductor 1, 2, 3 or 4. The depth of the channel is to be known beforehand in order to avoid damages in the bottom refractory due to over penetration of lance 8.

4. Repetition of the Process

The procedure is to be repeated for all inductors 1 to 4 until induction coils 5 attain such a power factor that it indicates the complete unblockage of side channels 6, bottom channel 7 and central channel 6'.

5. Recomposition of the Original Working Alloy

Once all channels 6, 6' and 7 in all inductors 1, 2, 3, 4 are cleaned, the same process of partial casting of the furnace should be carried out, adding aluminum alloys for recovering the normal contents of aluminum in the bath.

It is important for preservation of ferrous elements immersed in the molten alloy bath against the attack with alloys having a high aluminum contents, that the silicon contents of the aluminum bath be at least 1.5% and then increasing the aluminum contents of the bath.

Alloys having zinc-aluminum contents of values intermediate to those used for coating a steel sheet, are added to the furnace during working shifts in a gradual manner such that the normal operating conditions of the furnace are not altered, under control of the alloying elements and adjustment thereof when required by means of small ingots of intermediate alloys.

It is also known that other modifications may be made to the present invention, without departing from the scope of the present invention, as noted in the appended claims.

We claim:

1. A process for cleaning inductor channels, of furnaces melting non-ferrous metal alloys, comprising the steps of adding coating alloy having a minimum of zinc contents of 50% by weight to said inductor channels thereafter softening, diluting and floating of a slag thus obtained; removing the slag from the inductor channels by a mechanical scraping action of a movable lance having fins protruding therefor the removal of the slag aided by bubbling a nitrogen gas stream within the inductor channels, wherein said lance is provided with radial fins having predetermined shapes, for breaking the slag accumulated into the inductor channels, said lance moving and acting within the inductor channels to inject an inert gas against the slag, which slag has been previously broken by said radial fins of said lance and accumulated into the channels, wherein said radial fins have increasing variable diameters extending through a bore of the channels during several scraping-bubbling operations until said channels are cleaned, wherein further said lance with protruding radial fins is advanced against and through the slag by applying repeated hammer shocks by ramming hammers at a coupling end of said lance, for aiding in a penetration thereof into the slag accumulated within the channels.

2. The process as claimed in claim 1 wherein said ramming hammers are attached to a free end of said lance, and applying said hammer at a shock frequency of at least 5 shocks per minute.

3. The process as claimed in claim 2 wherein an inert gas is admitted into said lance for entraining the slag which has been previously broken by repeating mechanical action of said lance having said radial fins from within the inductor channels.

4. The process as claimed in claim 3 wherein said inert gas is nitrogen and wherein said nitrogen gas is admitted into said lance at a minimum pressure of 0.1 kg/cm$^2$.

* * * * *